US007614386B2

(12) United States Patent
Klems

(10) Patent No.: US 7,614,386 B2
(45) Date of Patent: Nov. 10, 2009

(54) FUEL PUMP

(75) Inventor: Josef Klems, Haltern am See (DE)

(73) Assignee: Willibrord Losing Filterproduktion GmbH, Hattingen (DE)

( * ) Notice: Subject to any disclaimer, the term of this patent is extended or adjusted under 35 U.S.C. 154(b) by 0 days.

(21) Appl. No.: 11/986,566

(22) Filed: Nov. 21, 2007

(65) Prior Publication Data

US 2008/0135008 A1 Jun. 12, 2008

(30) Foreign Application Priority Data

Nov. 23, 2006 (EP) ..... 06024302

(51) Int. Cl.
*F02M 1/16* (2006.01)

(52) U.S. Cl. ..... 123/509; 123/179.11; 417/440

(58) Field of Classification Search ..... 123/509, 123/179.9, 179.11; 417/440, 559
See application file for complete search history.

(56) References Cited

U.S. PATENT DOCUMENTS 2,249,326 A 7/1941 Rabe ..... 417/435
3,565,555 A 2/1971 Akashi ..... 417/568
4,500,425 A 2/1985 Thornton ..... 210/136
5,256,040 A 10/1993 Davis ..... 417/440
7,431,575 B2 * 10/2008 Hawkins et al. ..... 417/440

FOREIGN PATENT DOCUMENTS

DE 3638617 4/1988

* cited by examiner

*Primary Examiner*—Hai H Huynh
(74) *Attorney, Agent, or Firm*—Andrew Wilford

(57) ABSTRACT

A manually operable priming pump has a housing formed with an inlet port adapted to be connected to a supply of fuel and an outlet port adapted to be connected to a fuel-delivery system, a body in the housing between the ports and formed with a throughgoing main passage that is completely clear of obstructions. The body is shiftable between an operating position in which the main passage is aligned with the inlet and outlet ports and permits free flow therebetween and a pumping position, and a piston in the body can be manually reciprocated in the pumping position to draw fluid in through the inlet port and expel it from the outlet port.

14 Claims, 4 Drawing Sheets

FUEL PUMP

FIELD OF THE INVENTION

The present invention relates to a pump. More particularly this invention concerns a diesel-engine fuel pump.

BACKGROUND OF THE INVENTION

Pumps for feeding fuels are known in the practice in different designs. These pumps are generally installed on the fuel tank, which typically is at the rear or side of the vehicle, or close to the tank at the upstream tank end of the line that runs to the engine, typically at the front of the vehicle, where there is another pump forming part of the fuel-injection system of the internal-combustion engine. During operation of the internal-combustion engine the motor-driven fuel feed pump supplies the injection system with fuel.

When, however, the fuel tank is run completely empty, the fuel feed pump cannot bleed the fully drained fuel line after the tanks have been filled. To avoid damage to the fuel feed pump the fuel line is in most cases bled with a manually operated priming pump. To this end the tank-side fuel line is connected to the inlet and the engine-side fuel line to the outlet. To prevent the fuel from flowing back into the tank when bleeding during the pumping process, both the inlet and the outlet are provided with valves. Different pumps that are fitted with different types of valves are known from the state of the art. Fuel must also flow through the valves during normal operation of the internal-combustion engine, resulting in major pressure losses during the fuel feed process. This also means that the outlet of the fuel feed pump must be designed so that it is clearly over-dimensioned, making its manufacture expensive and costly. Because of the high pressure loss the pumps of prior art cannot satisfactorily meet the requirements that are imposed by diesel engines operated with high pressure injection systems in particular.

A further disadvantage of the known priming pumps practice consists in the fact that due to the stiffness of the pump piston the need to refill the fuel line is often difficult to detect since only the resistance of the piston during the pumping process is available as an indicator of the bleeding process that has taken place. Furthermore, the prior-art pumps art can only be installed in one prescribed alignment. Because of this it is often only possible at considerable cost to integrate such a pump in a fuel supply system so that both the alignment of the pump complies with the specifications of the manufacturer and perfect operability is guaranteed.

OBJECTS OF THE INVENTION

It is therefore an object of the present invention to provide an improved priming pump.

Another object is the provision of such an improved priming pump that overcomes the above-given disadvantages, in particular that is through which fuel flows with the minimum pressure loss during normal operation of an internal-combustion engine and with which the fuel line can nevertheless be easily and reliably bled.

SUMMARY OF THE INVENTION

A manually operable fuel pump has according to the invention a housing formed with an inlet port adapted to be connected to a supply of fuel and an outlet port adapted to be connected to a fuel-delivery system, a body in the housing between the ports and formed with a throughgoing main passage that is completely clear of obstructions. The body is shiftable between an operating position in which the main passage is aligned with the inlet and outlet ports and permits free flow therebetween and a pumping position, and pump means connected to the body manually operable for, in the pumping position, drawing fluid in through the inlet port and expelling it from the outlet port. Thus with the pump according to the invention in the operating condition, a connection can be made between the inlet and the outlet free from check valves.

It lies within the scope of the invention for the pump housing to be manufactured of one metal or plastic. In a preferred embodiment the housing is manufactured so that it is at least partially transparent, so that visual inspection can ascertain easily whether the fuel line supplying the fuel feed pump is air-free. In particular preference the housing consists of at least one metal and at least one plastic part. In this embodiment at least parts of the pump are transparent. The housing is suitably equipped with fastening elements that are preferably designed as bores.

The housing of the pump according to the invention preferably has one inlet and one outlet, which are preferably cylindrical in design and have the same diameter. In a particularly preferred embodiment the longitudinal axes of the cylindrically designed inlet and the cylindrically are coaxial. It is also preferable for at least the inlet and/or the outlet to be provided with a female thread.

According to a preferred embodiment, the housing is provided with a chamber that is connected to the inlet and the outlet. A rotor sleeve is movably mounted in the chamber and the connection, free of check valves, between the inlet and the outlet can be made by means of the rotor sleeve.

In principle a chamber of any geometrical shape ay be selected, but a cylindrical design is preferred. The chamber extends over at least part of the housing. Both the inlet and the outlet are typically connected to the chamber. One end of the chamber is suitably provided with a first opening that extends over the entire cylindrical cross-section. At the other end of the chamber is provided a second opening that extends at least over part of the cross-section of the chamber. The second opening is preferably surrounded radially by a recess on the outside of the housing.

The chamber is preferably arranged in the housing so that its central axis is perpendicular to the longitudinal axis of the aligned inlet and outlet, and in particular the central axis of the chamber and the longitudinal axis of the aligned inlet and outlet intersect. A sleeve that has a pump portion and a through-flow section, is suitably fitted to the chamber. It is lies within the scope of the invention for the sleeve to be provided with a cantering element that engages in a second opening of the chamber. The centering element is preferably a cylindrical extension centered on the sleeve on the side of the through-flow section. The sleeve preferably seals with the chamber in a clamped fashion.

In a preferred embodiment the sleeve is provided with at least one receiving groove fully enclosing the outer circumference, in which groove a sealing element is received. In a further preferred embodiment both the pump portion and the through-flow section are provided with at least one circumferential receiving groove for receiving sealing elements. Preferably the sealing elements are O rings. A receiving groove is preferably also provided in the cantering element. It lies within the scope of the invention for the sleeve to be retained by a clamping ring in the chamber provided in the receiving groove of the cantering element. Here the clamping ring is preferably supported in the recess on the outside of the housing surrounding the second opening.

The sleeve is preferably rotatably mounted in the chamber. In order to switch from the operating condition to the pumping condition a 90° rotation of the sleeve preferably takes place in the chamber. To prevent rotation over an angle of more than 90°, a groove extending over such an the arc is provided preferably in the chamber, into which groove a pin fastened to the sleeve engages. The groove is preferably arranged at a radial spacing from the second opening. The pin is then preferably arranged on the outside of the surface of the sleeve on the through-flow section side.

The sleeve is preferably equipped with a through passage, preferably with two through passages, namely with a throughgoing main passage and a throughgoing secondary passage.

To connect the inlet to the outlet the sleeve has in its through-flow section at least a main passage, the main passage having a cylindrical design in a preferred embodiment. The main passage is suitably arranged so that its longitudinal axis is perpendicular to the axis of the rotor sleeve. Preferably the rotor axis of the main passage intersects the rotor axis of the sleeve. It lies within the scope of the invention for the diameter of the through passage to be at least equal to the diameter of the inlet and the outlet. It also lies within the scope of the invention for a secondary passage to be arranged in the through-flow section adjacent to the main passage, which secondary passage is suitably arranged perpendicular to the main passage and to the rotor axis of the sleeve. The main and secondary passages preferably lie in one plane and form an their intersection a common intersection chamber. The intersection chamber is suitably connected to the inside of the pump portion of the sleeve by means of a connecting passage. The diameter of the main passage deviates from the secondary passage according to a preferred embodiment.

A preferred embodiment is characterized in that it is possible, by pivoting the sleeve, to switch from the operating condition to the pumping condition, and in that the sleeve is suitably engaged both in the operating condition and the pumping condition.

It lies within the scope of the invention for the chamber of the housing to be fitted with a latch that locks the sleeve in certain positions. A recess with a tapered edge is preferably arranged in the chamber for this purpose. A spring element and a ball are suitably received in the recess, the diameter of the ball being greater than the diameter of the recess. One segment of the ball that is pressed by the spring element against the tapered edge of the recess, projects from the recess and exerts a pressure on the sleeve. This latch is, in quite particular preference, positioned on the end of the chamber on which the second opening is arranged. The sleeve then preferably has indentations on the outside of the surface on the through-flow section side into which the ball segment projecting from the recess engages in locking positions, preferably in a clamping manner. By rotating the sleeve into locking positions flow passages are suitably formed for the fluid medium. A main flow passage, consisting of the inlet, the main passage and the outlet, is preferably formed in a first locking position. A secondary passage, consisting of the inlet, the secondary passage and the outlet, is preferably formed in a second locking position. According to a preferred embodiment the main passage is assigned to the operating condition and the secondary passage to the pumping condition. It lies within the scope of the invention for the main passage of the sleeve to connect the inlet to the outlet free of check valves in the operating condition. The main passage is suitably formed by rotating the sleeve into the first locking position. It lies within the scope of the invention for the main passage to be free from check valves. No check valves, such as shutoff valves, throttle valves or valves are therefore arranged in the main passage.

The secondary passage of the sleeve suitably connects the inlet to the outlet in the pumping condition, at least one check valve, preferably two check valves, being arranged in the secondary passage for the fluid medium assigned to the pumping condition.

If the sleeve is rotated from the first locking position assigned to the operating condition into the second locking position assigned to the pumping condition, the fluid medium flows through the secondary passage. In this case the secondary passage preferably has at least one check valve. In particular preference two check valves are placed in the secondary passage, between which elements, in a preferred embodiment, the connecting passage extends between the intersection of the main and secondary passages and the inside of the pump portion of the sleeve, e.g. the pump compartment. The check valves are, in quite particular preference, installed so that both check valves are only permeable in the direction of flow pointing from the inlet to the outlet.

The rotor or sleeve preferably has a pump portion forming the pump means and having a piston equipped with a support plate, and a through-flow section in which the at least one through passage is formed.

The pump portion of the sleeve is preferably connected in one piece to the through-flow section. A piston is preferably movably mounted in the pump portion. The piston preferably consists of an actuating element, a piston rod, a protective plate and a sealing element, the sealing element sealing fluid-tight against the inner wall of the pump portion. The sealing element is preferably pushed onto a thickening of the piston rod and is supported by the support plate. In particular preference the sealing element is pushed onto the support plate.

On the pump portion is suitably placed a cover that can be screwed, welded to this section or pressed onto it. The cover has a center opening through which the piston stem extends. The piston rod projecting from the cover is suitably provided with an actuating element or knob that, at least in the operating condition of the pump, can preferably be fixed to the cover. The fixing can in this case be achieved by a screw connection or the actuating element may also be fixed to the cover with a latch. In another design the pump portion may also be replaced by a motor-driven pump for bleeding.

The invention is based on the knowledge that the pump according to the invention can be installed on condition that a very low flow resistance is opposed to the fluid medium flowing through it in the operating condition, so that the resultant pressure loss is negligibly small. According to the invention there is no check valve causing pressure loss in the main passage assigned to the operating condition. If it is necessary to bleed the fuel line, the main passage free of check valves is rotated out of the direction of flow and replaced by the secondary passage, in which check valves are arranged, as a connection between the inlet and outlet of the pump. The fuel can then be pumped to the fuel feed pump by means of the pumping device and the check valves. If at least partially transparent materials are selected for the pump, the re-filling of the fuel line can also be monitored visually. In addition, the pump according to the invention can advantageously be integrated in any alignment in the fuel supply system without any functional impairment.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
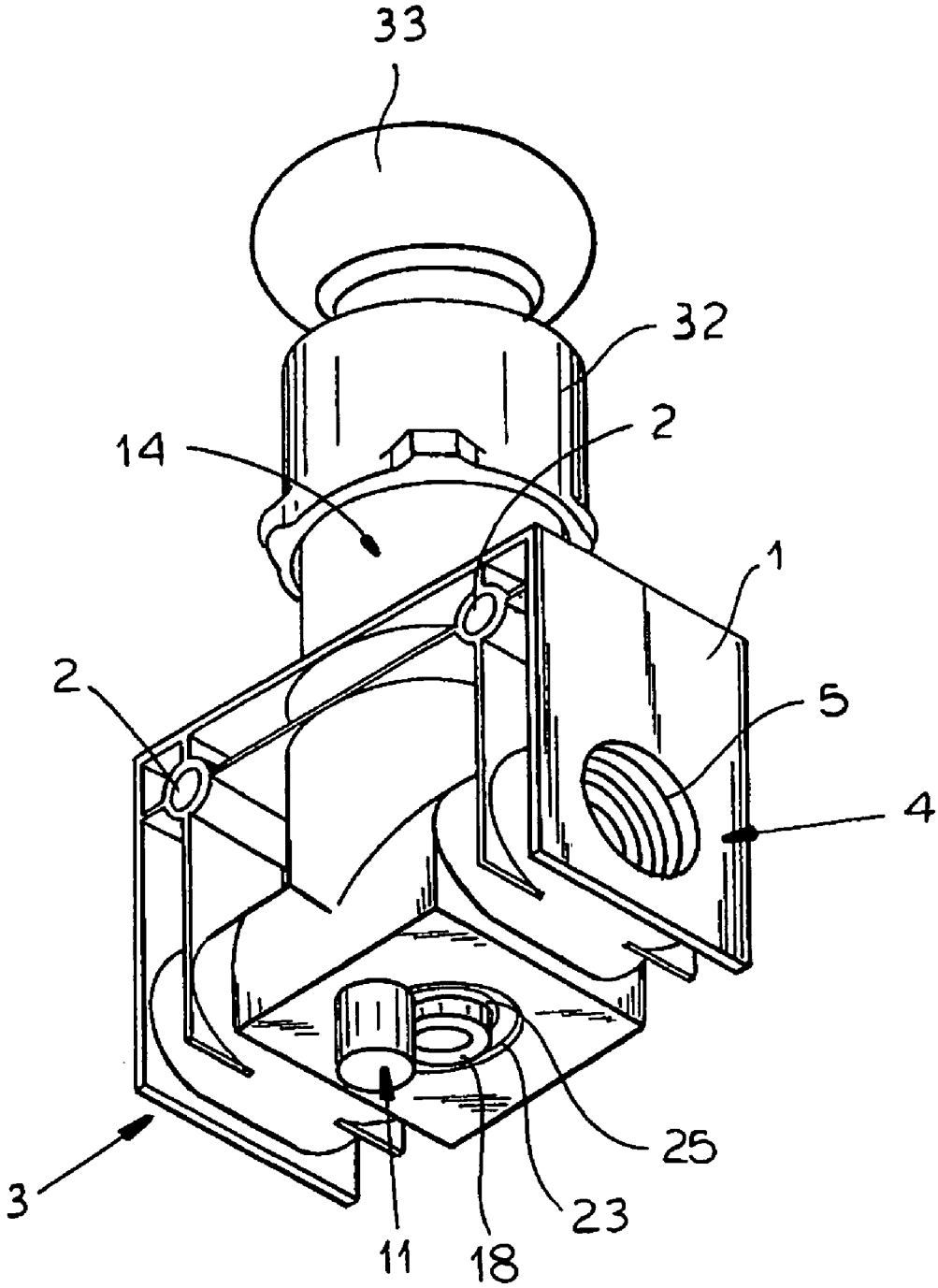
FIG. 1 is a perspective view of the pump according to the invention.
Figure 2:
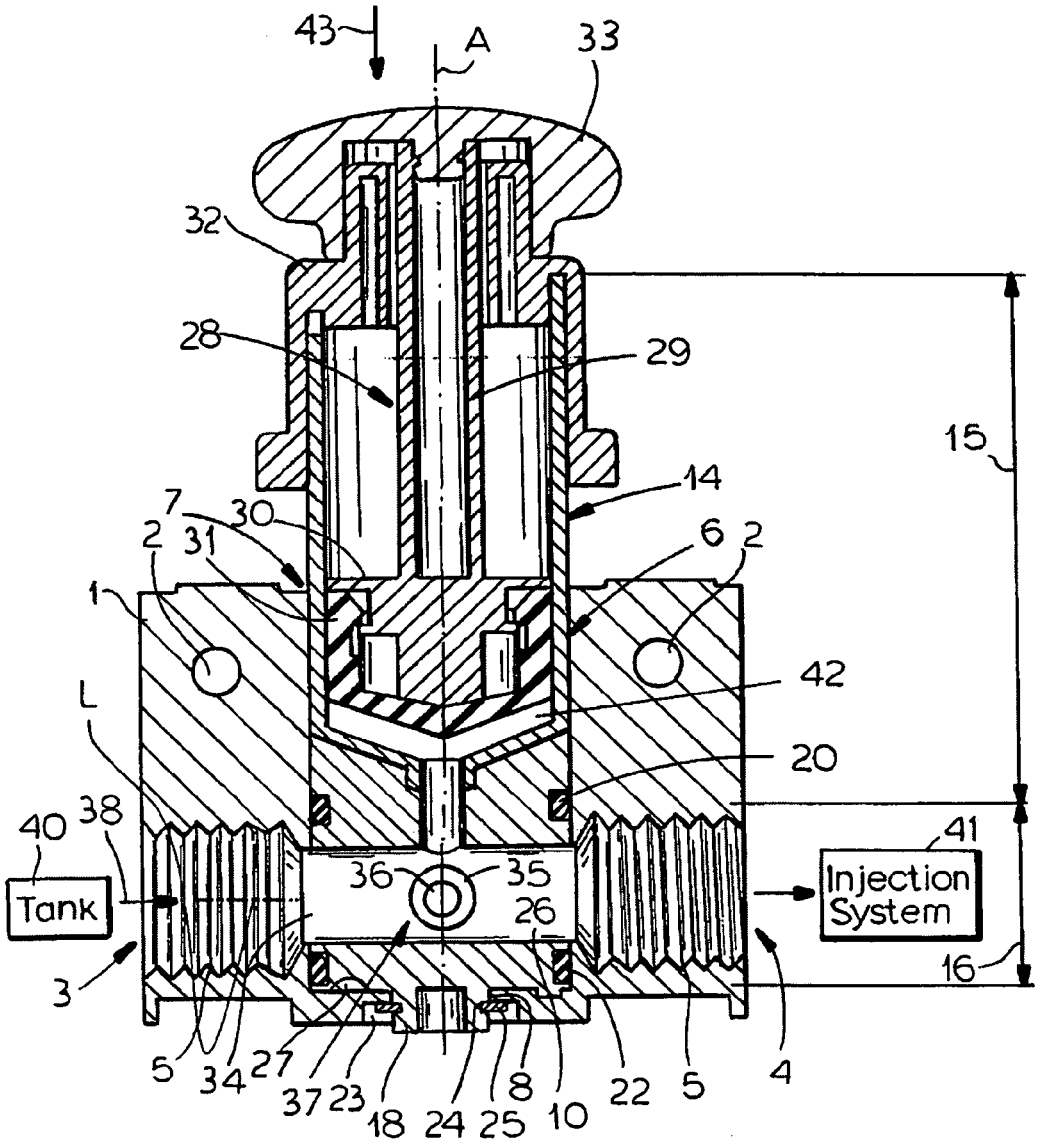
FIG. 2 is shows a section through the pump according to the invention in the operating position.
Figure 3:
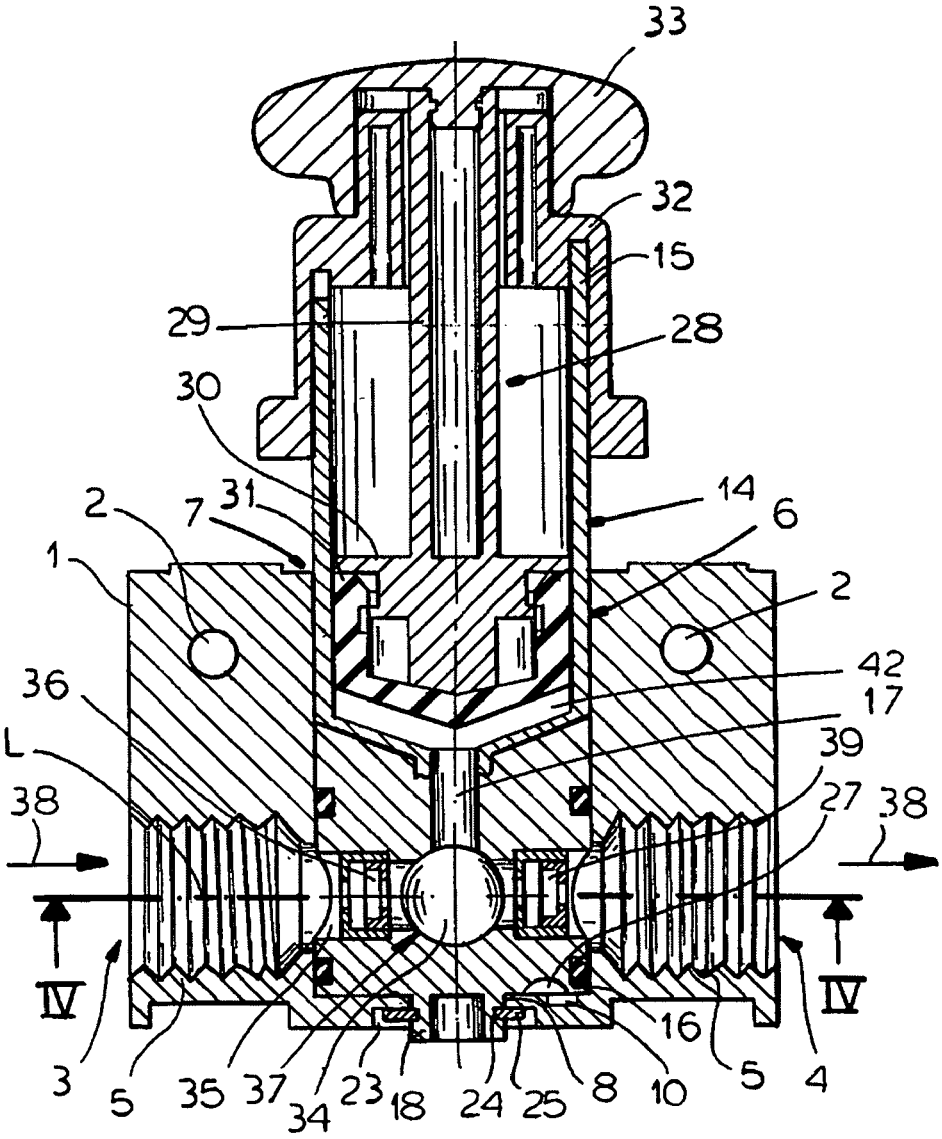
FIG. 3 shows a section through the pump according to the invention in the pumping position.

As seen in FIGS. 1-3 a manually operably priming pump for a diesel engine has a housing 1 formed centered on a flow axis L with coaxial inlet and outlet ports 3 and 4, the former connected to a fuel tank 40 and the latter to an injection system 41. During normal operation the pump according to the invention is in the position of FIG. 2, allowing fuel to flow freely from the unillustrated pump at the tank 40 to the injection system 41 that has its own pump. The inlet 3 and outlet 4 are preferably formed with internal screwthreads 5 for connection to the unillustrated upstream and downstream fuel lines. Holes 2 in the housing 1 allow it to be bolted to the vehicle frame at some accessible location.

The housing 1 forms a cylindrical chamber 6 centered on a rotor axis A that is vertical and perpendicular to the flow axis L of the inlet and outlet ports 3 and 4. The chamber 6 opens at the top of the housing at a full-diameter circular opening 7 and at the bottom of the housing at a coaxial smaller circular opening 8. The opening 8 is counterbored on the outside at a recess 23. The inlet 3 and outlet 4 open diametrally into opposite sides of the chamber 6.

A cylindrical rotor body 14 in the chamber 6 has a sleeve-shaped upper pump part 15 and a lower part 16 aligned with the inlet 2 and outlet 4. At its lower end the rotor 14 has a short cylindrical extension 18 fitting complementarily through the opening 8 and secured in the counterbore 23 by a snap ring 25 set in a groove 24, so that the rotor 14 can rotate about the rotor axis A but not move axially of it. At its upper end the rotor 14 projects out of the housing 1. Radially outwardly open grooves 20 above and below the ports 3 and 4 hold O-rings 22 that seal against the cylindrical inner surface of the chamber 6.

The lower portion 16 of the rotor 14 is formed with two throughgoing passages 34 and 35 extending perpendicular to each other and alignable in 90° offset positions of the rotor 14 relative to the rotor axis A with flow axis L of the inlet 3 and outlet 4. During normal use the main passage 34 is aligned as shown in FIG. 2 with the flow axis L for free flow in the direction 38 into the housing 1 from the tank 40 and from the housing 1 to the injection system 41. To this end the main passage 34 is cylindrical, of uniform cross section, and completely free of any obstructions so that the priming pump according to the invention does not present any significant resistance to fuel flow. This FIG. 2 position is the position during normal flow of fuel from the tank 40 to the system 41

Figure 4:
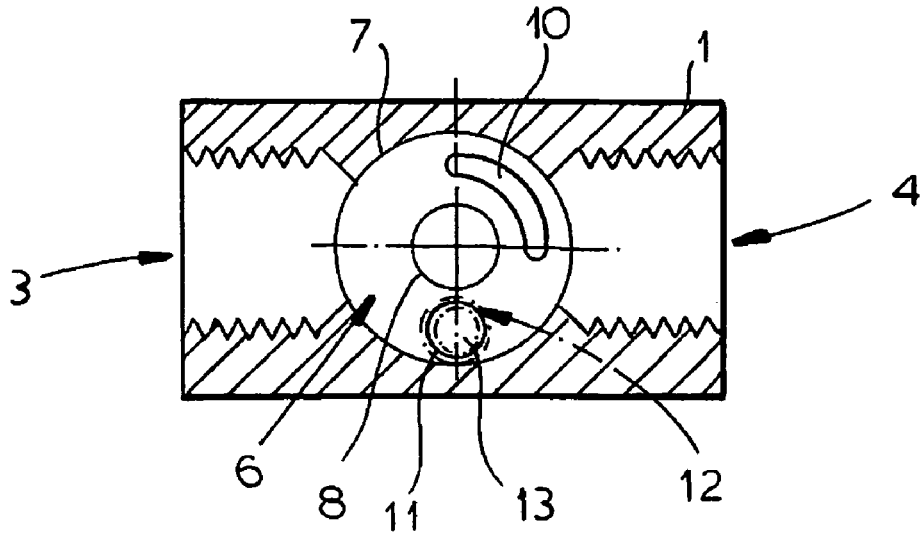
FIG. 4 is a section taken along line IV-IV of FIG. 3.
Figure 5:
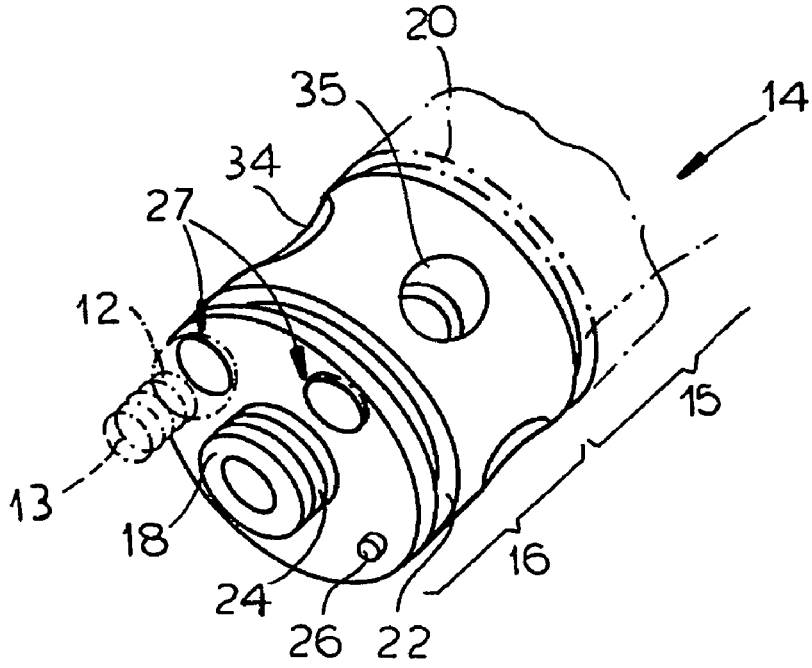
FIG. 5 is a perspective view of a region of a through-flow section of a sleeve for the pump according to the invention.

The bottom of the rotor 14 is formed at its lower end face offset from the rotor axis A with a short axially downwardly projecting cylindrical pin or bump 26 that engages in an axially upwardly open groove 10 shown in FIG. 4 that extends over a little more than a 90° circular arc in an upwardly directed face of the housing 1. Thus rotation of the rotor 14 about the rotor axis A is limited to 90° that is an operating position with the main passage 34 aligned with the flow axis L and a pumping or priming position with the secondary passage 35 aligned with the axis L. A spring 13 (FIG. 5) held in an axially upwardly open seat 11 in the bottom of the chamber 6 can press a ball 12 into either of two 90° offset axially downwardly open recesses or seats 27 to retain the rotor 14 in its 90° angularly offset end positions. Both of these structures could be reversed, with the seats 27 and pin 26 on the housing 1, for instance.

The two passages 34 and 35 meet centrally in the rotor at a crossing 37 that communicates via a small-diameter passage 17 extending upward in the rotor 14 to a cylindrical pumping compartment 42 formed coaxially of the rotor axis A in the upper rotor portion 15. A piston 28 has in the compartment 42 a lower end 30 carrying a cup-shaped rubber cap 31 fitting snugly in the compartment 42 and a stem 29 extending upward from the lower end 30 through a cover 32 engaged over the outer end of the portion 15 to an end knob 33. The entire piston 28 can be reciprocated vertically limitedly parallel to the rotor axis A as indicated by arrow 43.

As mentioned above, the main passage 34 is smooth, cylindrical, and of uniform cross sectional size. The secondary passage 35 is as shown in FIG. 3 of somewhat smaller diameter and provided with a pair of check valves 36 and 39 flanking the passage 17. When the secondary passage 35 is aligned in the FIG. 3 priming position of the rotor 14 with the flow axis L, flow is possible only in the direction 38 that is from left-to-right as shown in FIG. 3 through the passage 35. In this priming position the outer ends of the passage 34 are blocked by the inner surface of the chamber 6 so that no flow from the ends of this passage 34 is possible.

If, for instance, the tank 40 has been drained so that air has been sucked into the system and in fact along the main passage 34 through the housing 1, the user grasps the knob 33 and rotates the rotor 14 through 900 to the FIG. 3 priming position. Once in this position the user pulls up on the knob 33 and thereby raises the piston 28, sucking air and fuel from the tank 40 in direction 38 into the housing 1, and pulling it through the upstream check valve 36 up through the passage 17 into the compartment 42. During this suction stroke the downstream check valve 39 remains closed. The knob 33 is then pushed forcibly downward, pushing the fuel and/or air in the compartment 42 down through the passage 17 and out through the downstream check valve 39 in the direction 38. During this pressure stroke the upstream check valve 36 remains closed. This action is repeated until the fuel line is primed all the way to the injection system 41.

I claim:

1. A manually operable fuel pump comprising:

a housing formed with an inlet port adapted to be connected to a supply of fuel and an outlet port adapted to be connected to a fuel-delivery system and with a chamber communicating with both ports;

a sleeve in the chamber and between the ports and formed with a main passage that is completely clear of obstructions and with a secondary passage, the sleeve being shiftable between an operating position in which the main passage is aligned with the inlet and outlet ports and permits free flow therebetween and a pumping position in which the main passage is blocked and the secondary passage is aligned with the inlet and outlet ports;

a check valve in the secondary passage only permitting flow therethrough in the pumping position from the inlet port to the outlet port and pump means connected to the sleeve manually operable for, in the pumping position, drawing fluid in through the inlet port and expelling it from the outlet port.

2. The pump defined in claim 1 wherein the chamber and sleeve are coaxially centered on a rotor axis and the sleeve is a rotor rotatable in the chamber about the rotor axis between the operating position and pumping position.

3. The pump defined in claim 2 wherein the main passage extends generally diametrally of the rotor axis through the rotor.

4. The pump defined in claim 3 wherein the main passage is cylindrical, of uniform cross-sectional size and shape, and is completely free of any internal structures.

5. The pump defined in claim 3 wherein the secondary passage extends generally diametrally of the rotor axis and intersects and crossing crosses the main passage, the rotor further being formed with a connecting passage connected to the pump means and opening generally centrally into the secondary passage.

6. The pump defined in claim 5 wherein the secondary passage is provided with two of the check valves flanking the connecting passage and oriented so as to permit flow along the secondary passage in the pumping position only from the inlet to the outlet.

7. The pump defined in claim 6 wherein the pump means includes a compartment formed in the sleeve offset from the passages and connected to the secondary passage by the connecting passage, and a piston fitting snugly in and reciprocal in the compartment toward and away from the secondary passage, whereby movement of the piston away from the connecting passage draws fluid from the inlet port through one of the check valves and the connecting passage into the compartment and movement of the piston toward the connecting passage pushes fluid from the compartment through the connecting passage and the other of the check valves to the outlet port.

8. The pump defined in claim 7 wherein the piston is reciprocal along the rotor axis.

9. The pump defined in claim 8 wherein the connecting passage extends along the rotor axis.

10. The pump defined in claim 5 wherein the main and secondary passages extend at a predetermined angle of about 90° to each other, further comprising means for limiting rotation of the rotor in the housing about the rotor axis substantially to the predetermined angle.

11. The pump defined in claim 10 wherein the housing and the pump have axially confronting faces, the rotation-limiting means comprising an axially open arcuate groove formed on one of the faces, centered on the axis, and having an angular dimension equal to slightly more than the predetermined angle, and a projection on the other of the faces projecting into the groove.

12. The pump defined in claim 5 wherein the main and secondary passages extend at a predetermined angle of about 90° to each other and the housing and the pump have axially confronting faces, the pump further comprising:

a pair of seats formed on one of the faces offset from the axis and spaced apart angularly by the predetermined angle; and a spring-loaded element projecting from the other of the faces and engageable in the seats.

13. In combination with a diesel-fuel tank and with a fuel-injection system of a motor vehicle, a priming pump comprising:

a housing formed with an inlet port connected to the tank and an outlet port connected to the fuel-injection system;

a rotor sleeve in the housing between the ports, pivotal about a rotor axis between a priming position and a through-flow operating position, and formed with a compartment, a main passage that is completely clear of obstructions and that extends between the ports only in the operating position, whereby in the operating position fuel can flow freely from the tank to the injection system, outer ends of the main passage being blocked by the housing in the priming position, a secondary passage that extends between the ports only in the priming position and that crosses and intersects with the main passage, outer ends of the secondary passage being blocked by the housing in the operating position, and a connecting passage extending from the intersection of the main and secondary passages and opening into the compartment;

upstream and downstream check valves in the secondary passage flanking the connecting passage and permitting flow in the priming position from the inlet port to the connecting passage and from the connecting passage to the outlet port; and pump means including a piston axially reciprocal in the compartment in the rotor sleeve and manually operable for, in the pumping position, drawing fluid into the compartment through the inlet port, the connecting passage, and one of the check valves and expelling it from the compartment through the secondary passage and the other of the check valves and from the outlet port.

14. The priming pump defined in claim 1 wherein in the operating position the secondary passage is blocked.

* * * * *